United States Patent [19]

Smith

[11] Patent Number: 4,802,788

[45] Date of Patent: Feb. 7, 1989

[54] ROAD MARKING APPARATUS

[75] Inventor: Martin A. Smith, Atlanta, Ga.

[73] Assignee: Pave-Mark Corporation, Atlanta, Ga.

[21] Appl. No.: 143,369

[22] Filed: Jan. 13, 1988

[51] Int. Cl.[4] ..... E01C 23/16

[52] U.S. Cl. ..... 404/94; 404/105

[58] Field of Search ..... 404/93, 94, 98, 104, 404/105, 108, 110, 111; 118/413, 415; 239/455, 456; 222/502

[56] References Cited

U.S. PATENT DOCUMENTS

| | | | |
|---|---|---|---|
| 1,923,632 | 8/1933 | Macrae et al. | 404/94 |
| 2,691,923 | 10/1954 | Huck | 404/94 |
| 3,018,704 | 1/1962 | Searight | 404/94 |
| 3,070,822 | 1/1963 | Lipkins | 15/503 |
| 3,682,054 | 8/1972 | MacPhail et al. | 404/94 X |
| 3,733,140 | 5/1973 | James, III | 404/98 |
| 3,994,611 | 11/1976 | Sipkema | 404/94 |
| 4,269,328 | 5/1981 | Franklyn | 118/415 X |

FOREIGN PATENT DOCUMENTS

| | | | |
|---|---|---|---|
| 63781 | 11/1982 | European Pat. Off. | 404/94 |
| 2248982 | 5/1973 | Fed. Rep. of Germany | 404/93 |
| 2527664 | 12/1983 | France | 404/93 |

*Primary Examiner*—Jerome W. Massie
*Assistant Examiner*—Matthew Smith
*Attorney, Agent, or Firm*—Thomas & Kennedy

[57] ABSTRACT

A road marking apparatus has a hopper mounted upon a pair of side runners that straddle an outlet in the bottom of the hopper. A doctor blade is mounted for reciprocal vertical movement in sliding contact with the outside of a rear wall of the hopper adjacent the hopper outlet between the runners. A floor gate is mounted for reciprocal horizontal movement into and out of contact with a bottom edge of the hopper rear wall and the doctor blade for opening and closing the hopper outlet.

4 Claims, 2 Drawing Sheets

ROAD MARKING APPARATUS

TECHNICAL FIELD

This invention relates to apparatuses for marking roads, and particularly to apparatuses and devices for marking roads with lane lines of alternating line thickness.

BACKGROUND OF THE INVENTION

Today the surfaces of roads, highways, parking lots and the like are commonly painted with lines or stripes that designate traffic control and parking lanes. In doing so paint, heated thermosetting or reactive setting plastic marking materials, are applied to asphalt and concrete road surfaces. This is done with the use of mobile road marking equipment that has a material hopper from which material is dispensed by means of a spray or extrude apparatus. The screed/extrusion device involves an apparatus commonly referred to in the industry as a die which is mounted on the road marking equipment to be dragged on the raod. The apparatus or die itself has a small hopper in which the preheated marking material is poured from the larger equipmet hopper and then guided through an outlet in the bottom of the die hopper directly onto the surface of the road as the apparatus is advanced over the road surface. These apparatuses or dies commonly have a pair of side runners between which the material contacts the road surface. The runners thus serve both to provide sliding supports for the bottom material flow closable floor die gate as well as to provide side forms which limit lateral flow of the marking material and thereby define the side edges of the marked line. To terminate the end of a line, a valve or sliding floor gate is actuated to close the outlet in the bottom of the die hopper.

In recent years road marking apparatuses or dies have been provided with means for periodically altering the thickness or height of the road marking material. This has been done to provide discontinuities or ridges in the surface plane of the road lines or stripes which in turn enhance the reflectivity of the line from vehicle headlights as a visual aid to motorists. Exemplary of such an apparatus is that shown in U.S. Pat. No. 3,994,611. It employs a vertical slide plate or doctor blade mounted to the rear end of its hopper for reciprocal, vertical movement. In use, marking material that has just flowed out of the die hopper onto a roadway surface between the apparatus runners is beveled by the bottom edge of the trailing doctor blade. As the blade periodically changes its elevation over the road surface the surface elevation of the marking material is changed prior to the material setting and hardening. In this manner steps or ridges are periodically formed along the line at two different elevations above the road surface which steps are connected by sloping sections.

Though road marking apparatuses of the type just described do operate well in varying the height or thickness of road marking materials, such has been done at a sacrifice in making sharp line terminations. This is because apparatuses have used the doctor blade itself to scoop up terminal portions of the marking material from the road surface back into the hopper as shown in the previously mentioned patent. As a result terminal portions of the lines have often had a very thin layer of residual material left on the roadways since their surfaces are rarely smooth but have small pits in which residual material may reside even after having been swept by the doctor blade.

Accordingly, it is seen that a need remains for a road marking apparatus of a type which has the capability of forming road lines of varying heights or thicknesses with improved means for providing clean and sharp line demarcations. It is to the provision of such therefore that the present invention is primarily directed.

SUMMARY OF THE INVENTION

In one form of the invention road marking apparatus comprises a pair of side runners and a hopper mounted upon the side runners in which fluid marking material may be held. The hopper has front and rear walls joined by side walls and an outlet through which fluid marking material may flow out of the hopper and onto the surface of a road between the side runners. A doctor blade is mounted for vertical reciprocal movement in sliding contact with the outside of the hopper rear wall adjacent the hopper outlet for varying the thickness of marking material applied to a road surface. A floor gate is mounted for generally horizontal reciprocal movement into and out of sealing engagement with a bottom portion of the hopper rear wall in closing and opening the hopper outlet.

In another form of the invention road marking apparatus comprises a hopper having an inlet in an upper portion thereof and an outlet in a lower portion thereof. A pair of runners are mounted to the bottom of the hopper straddling the hopper outlet. A doctor blade is mounted for vertical reciprocal movement between the runners. A floor gate is mounted for reciprocal movement into and out of sealing contact with the doctor blade for closing and at least partially opening the hopper outlet.

DESCRIPTION

Figure 1:
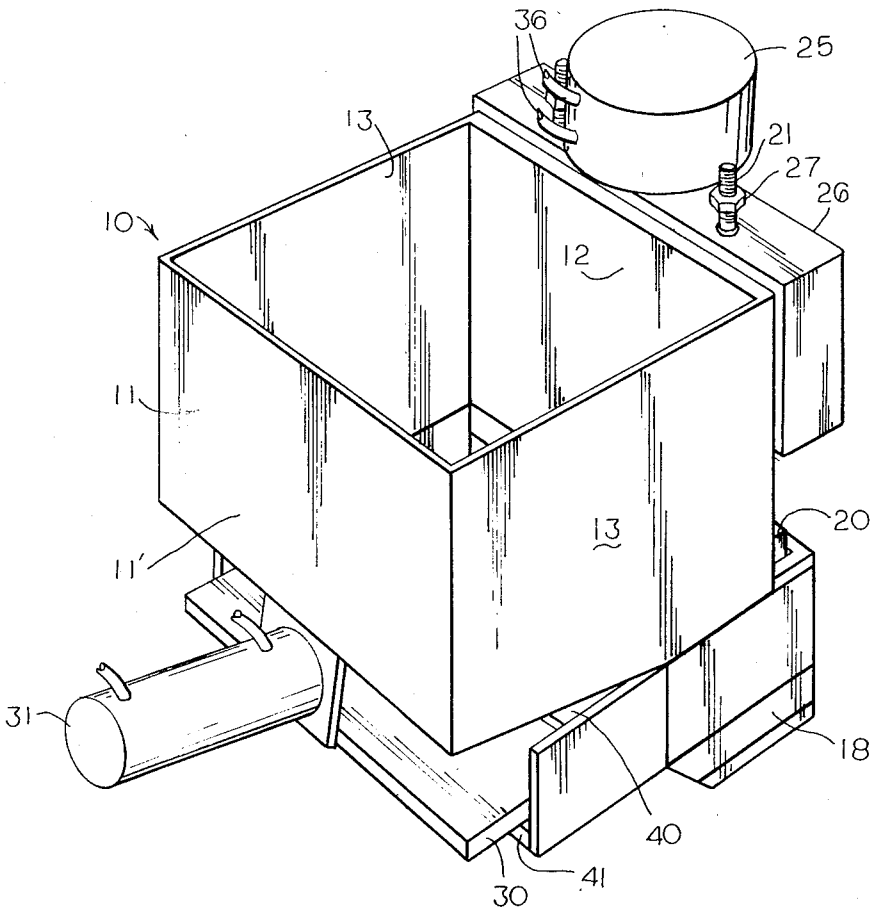
FIG. 1 is a perspective view of road marking apparatus that embodies principles of the invention in a preferred form.

With reference to the drawing, there is shown a road marking apparatus or die that has an open top hopper indicated generally at 10 which has a front wall 11 joined to a rear wall 12 by two side walls 13. The front wall has an upper upright portion 11' that is joined with a lower upright portion 11'' by a sloping intermediate portion 11'''. The rear wall 12 includes a wear plate 12' and a mounting block 12'' to which the wear plate is mounted. The open top of the hopper provides an inlet 15 into which a heated, fluid thermosetting road marking material 16 may be poured. The bottoms of the side walls 13, the rear wall wear plate 12' and the lower front wall portion 11'' collectively define an outlet 16. This outlet is substantially straddled by a pair of runners 18 that are mounted to the bottom of the hopper in general alignment with the hopper side walls.

With continued reference to the drawing, the road marking apparatus is further seen to have a doctor blade 20 mounted in sliding contact with outside surfaces of the wear plate 12' and the mounting block 12". The doctor blade is coupled by a pair of rods 21 which straddle a rear platform to an air cylinder 25. The cylinder is mounted upon the top of a case 26 that is rigidly mounted to the back of the hopper rear wall 12. A nut 27 is mounted to an upper end portion of each rod 21 that movably protrudes out of the top of the case 26. Within the case the two rods 21 are coupled to the air cylinder piston. Actuating of the air cylinder 25 thus causes the doctor blade to be raised and lowered between its positions shown in FIGS. 2 and 3.

The road marking apparatus further includes means for controlling the flow of marking materials out of the outlet 16 and onto the surface of a road being marked. This means includes a floor gate 30 which slidably extends through the lower portion 11" of the hopper front wall. The floor gate is reciprocally driven horizontally by another air cylinder 31 which is mounted beneath the hopper front wall portion 11'. The air cylinder 31 has a piston rod 32 that extends into a clevis 33 which is pivotally mounted to a pair of pillow blocks 34 that are rigidly mounted atop the floor gate 30. The air cylinder 31 has air lines 35 that are coupled to an unshown source of pressurized air and air controller, as does the other air cylinder 25.

Figure 2:
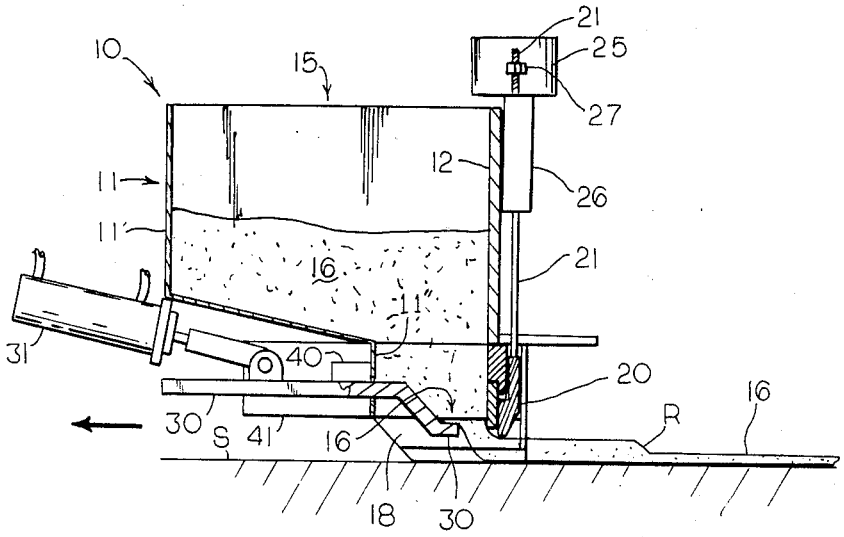
FIG. 2 is a side elevational view, in cross-section, of the apparatus illustrated in FIG. 1 shown applying road marking material to the surface of a road with its hopper outlet open.
Figure 3:
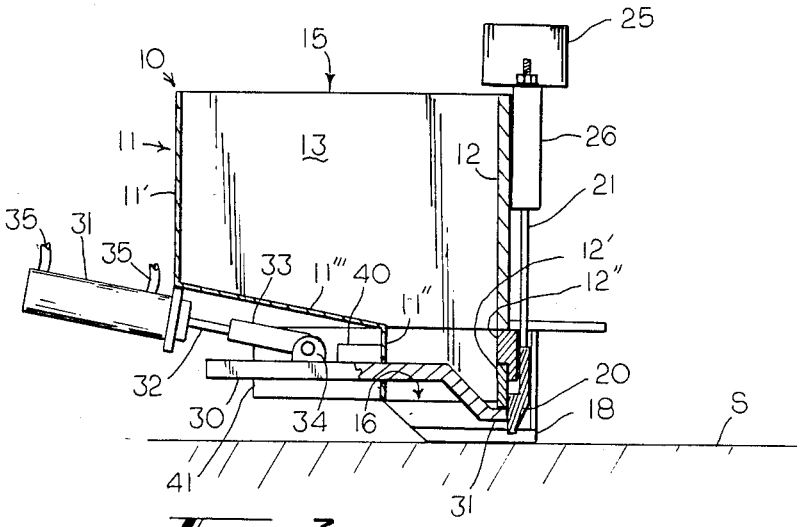
FIG. 3 is another side elevational view, in cross-section, of the apparatus illustrated in FIG. 1 shown with its hopper outlet closed.

As shown in FIGS. 2 and 3, a portion of the floor gate 30 resides outside of the hopper while another portion resides inside the hopper and its outlet 16. The outside portion is slidably positioned between an upper tongue plate 40 and a lower tongue plate 41 that project forwardly from the lower portion 11" of the hopper front wall. A Teflon sealing material is preferably mounted on the bottom of the upper tongue to provide a seal. Thus, tongues provide both a guide means for the floor gate 30 as well as a seal for preventing fluid marking material from exiting the hopper through the wall slot through which the floor gate extends. The sides of the floor gate within the hopper slidably contact the hopper sides 13.

The portion of the floor gate located substantially within the bounds of the hopper and its outlet is formed with a downward jog that terminates with an end portion or tip 31. As seen from FIGS. 2 and 3 this tip is in the shape of a rectangular plate with right angular corners. It is positioned for movement between an outlet open position shown in FIG. 2, spaced from the hopper rear wall and the doctor blade, and an outlet closed position in intimate contact with both the hopper rear wall and the doctor blade as shown, in FIG. 3. Specifically, when the floor gate 30 is in the position shown in FIG. 3 its tip rear gate is in sealing engagement with a side of the doctor plate 20 while its upper surface is in sealing engagement with the bottom edge of the wear plate 12'. It should also be noted that the end edge of the floor gate tip would still engage the doctor blade if it were in its raised position as shown in FIG. 2. In this manner an excellent seal is formed in closing the hopper outlet when the floor gate is closed due to the fact that two of its surfaces are in intimate contact with a corner provided by the wear plate and doctor blade. Furthermore, a sharp cut-off of material flow is achieved as the tip 31 initially moves into sliding contact with the bottom of the wear plate.

For use the apparatus is set upon a surface to be marked, such as a concrete or asphalt road coupled with unshown equipment on wheels that moves the apparatus and supplies it with hot marking material. The apparatus is then dragged forwardly in the direction shown by the arrow in FIG. 2 by the mobile equipment. Heated fluid marking material is introduced into the hopper 10 with the outlet 16 closed, as shown in FIG. 3. To commence marking the air cylinder 31 is actuated thereby drawing the floor gate to the open position shown in FIG. 2 whereupon the marking material 16 exits through that portion of the outlet that is opened between the floor gate and hopper rear wall.

Periodically the air cylinder 25 is actuated so as to alter the elevation of the bottom of the doctor blade 20 above the road surface S. The period employed is dependent on the length of the line between changes in thickness, the speed of advance and on whether the line is continuous or broken. In this manner the thickness or height of the marking material 16 is varied as from, for example, a height or thickness of 20 mils and a height or thickness of 250 mils, as shown in FIG. 2. When this is done it is seen that sloping steps are periodically formed that provides a potentially more reflective surface R that connects the two sections of diverse but uniform heights. When it is desired to terminate a line, the air cylinder 31 is actuated so as to urge the floor plate tip 30' to the position illustrated in FIG. 3 thereby abruptly terminating the flow of liquid marking material out of the hopper through its outlet.

It has been found that with both flow commencement and termination a relatively sharp line end is formed by virtue of the unique cooperative structure of the floor gate 30, the wear plate 11' and the doctor blade 20, regardless of the particular elevation of the doctor blade at the time when flow termination or commencement is made. It has also been found that seals of high integrity are effected both at the point where the floor gate enters the hopper as well as the floor gate exit sealing engagement with the rear wall and doctor blade.

It should be understood that the just described embodiment merely illustrates principles of the invention in a preferred form. Many modifications, additions and deletions may, of course, be made thereto without departure from the spirit and scope of the invention as set forth in the following claims.

I claim:

1. Road marking apparatus comprising a pair of side runners; a hopper mounted upon said pair of side runers in which a fluid marking material may be held, said hopper having front and rear walls joined by side walls with the bottom of said rear wall defining a boundary of an outlet through which fluid marking material may flow out of the hopper and onto the surface of a road between said side runners; a doctor blade means mounted for generally vertical reciprocal movement in sliding contact with the outside of said hopper rear wall adjacent said hopper outlet for varying the thickness of marking material applied to a road surface; and a floor gate mounted for generally horizontal reciprocal movement into and out of sealing engagement with a bottom edge of said hopper rear wall and a surface of the doctor blade facing the floor gate leading edge in closing and opening said hopper outlet.

2. The road marking aparatus of claim 1 wherein said floor gate is also mounted for reciprocal movement into and out of sealing engagement with said doctor blade.

3. Road marking apparatus comprising a hopper having an inlet in an upper portion thereof and a wall having a bottom edge that partially defines an outlet in a lower portion thereof; a pair of runners mounted to the bottom of said hopper straddling said hopper outlet; a doctor blade mounted for generally vertical reciprocal movement between said runners in sliding contact with an outer surface of said hopper wall adjacent said bottom edge; and a floor gate mounted for reciprocal movement into and out of sealing contact with said doctor blade and said bottom edge for closing and at least partially opening said hopper outlet.

4. The road marking apparatus of claim 3 wherein said floor gate is mounted for movement into and out of sliding contact with said hopper wall bottom edge.

* * * * *